US011798508B2

(12) United States Patent
Jeong

(10) Patent No.: US 11,798,508 B2
(45) Date of Patent: Oct. 24, 2023

(54) DISPLAY DEVICE AND METHOD FOR OPERATING SAME

(71) Applicant: LG ELECTRONICS INC., Seoul (KR)

(72) Inventor: Wonsang Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/629,347

(22) PCT Filed: Aug. 20, 2019

(86) PCT No.: PCT/KR2019/010560

§ 371 (c)(1),
(2) Date: Jan. 21, 2022

(87) PCT Pub. No.: WO2021/033796

PCT Pub. Date: Feb. 25, 2021

(65) Prior Publication Data

US 2022/0319458 A1 Oct. 6, 2022

(51) Int. Cl.

| | |
|---|---|
| ***G09G 3/36*** | (2006.01) |
| ***G09G 3/32*** | (2016.01) |
| ***G09G 3/34*** | (2006.01) |

(52) U.S. Cl.

CPC ..... *G09G 3/3618* (2013.01); *G09G 3/32* (2013.01); *G09G 3/3406* (2013.01);
(Continued)

(58) Field of Classification Search

CPC ..... G09G 3/32; G09G 3/34; G09G 3/3406; G09G 3/3426; G09G 3/3618;
(Continued)

(56) References Cited

U.S. PATENT DOCUMENTS 8,289,268 B2 * 10/2012 Park ..... G09G 3/3406 345/102
9,916,799 B1 * 3/2018 Jo ..... G09G 3/2092
(Continued)

FOREIGN PATENT DOCUMENTS

JP 2018173619 11/2018
KR 10-2007-0076078 7/2007
(Continued)

OTHER PUBLICATIONS

PCT International Application No. PCT/KR2019/010560, International Search Report dated May 20, 2020, 2 pages.
(Continued)

*Primary Examiner* — Jason M Mandeville
(74) *Attorney, Agent, or Firm* — LEE HONG DEGERMAN KANG WAIMEY

(57) ABSTRACT

The present invention relates to a display device having a more improved variable refresh rate (VRR) function, and comprises: a control unit for executing a variable refresh rate (VRR) function of adjusting a screen refresh rate according to an image signal; and a display unit for outputting an image according to the screen refresh rate, wherein the control unit can increase the screen refresh rate adjusted according to the image signal.

10 Claims, 13 Drawing Sheets

(52) U.S. Cl.
CPC ... *G09G 3/3426* (2013.01); *G09G 2310/0237* (2013.01); *G09G 2310/0264* (2013.01); *G09G 2320/0247* (2013.01); *G09G 2320/0252* (2013.01); *G09G 2320/0646* (2013.01); *G09G 2340/0435* (2013.01)

(58) Field of Classification Search
CPC ... G09G 2310/0237; G09G 2310/0264; G09G 2310/0243; G09G 2320/0247; G09G 2320/0646; G09G 2320/0252; G09G 2340/0435
USPC ..... 345/204
See application file for complete search history.

(56) References Cited

U.S. PATENT DOCUMENTS

2004/0183821 A1* 9/2004 Woo ..... H05B 47/19 345/691
2008/0100598 A1 5/2008 Juenger
2009/0237391 A1* 9/2009 Yanagi ..... G09G 5/18 345/99
2014/0198138 A1* 7/2014 Nambi ..... G09G 3/36 345/87
2014/0320039 A1* 10/2014 Kao ..... G09G 3/3426 315/250
2014/0362292 A1* 12/2014 Lee ..... G09G 3/3406 348/547

FOREIGN PATENT DOCUMENTS

KR 10-2011-0044682 4/2011
KR 101227284 2/2013
KR 101609948 4/2016
KR 1020170123392 11/2017

OTHER PUBLICATIONS

Korean Intellectual Property Office Application No. 10-2021-7037156, Office Action dated Feb. 20, 2023, 7 pages.

* cited by examiner (a)

(b)

DISPLAY DEVICE AND METHOD FOR OPERATING SAME

CROSS-REFERENCE TO RELATED APPLICATIONS

This application is the National Stage filing under 35 U.S.C. 371 of International Application No. PCT/KR2019/010560, filed on Aug. 20, 2019, the contents of which are all incorporated by reference herein in its entirety.

TECHNICAL FIELD

The present disclosure relates to a display device and a method for operating the same, and more particularly, to a display device having an improved variable refresh rate (VRR) function and a method for operating the same.

BACKGROUND ART

A variable refresh rate (VRR) function may be a function of synchronizing a source with a display device to provide an environment which is more flexible and provides details in a game mode.

Such a VRR function is referred to as FreeSync or G-Sync depending on a developing company.

The display device may support the VRR function to output an image to a screen in synchronization with timing of receiving an image frame, thereby reducing Screen Tearing caused, as a frame rate of the image is mismatched from a refresh rate.

In the VRR function, the screen refresh rate of the display device may be adjusted to be in the range of about 48 Hz to 120 Hz. In this case, when the screen refresh rate is adjusted to be excessively lowered, even an operating frequency of a backlight unit is lowered, thereby causing a flicker phenomenon.

In addition, even though the screen refresh rate is adjusted, local dimming is not controlled in real time. Accordingly, the local dimming mismatched from an output image is performed, so a contrast ratio is not optimized.

DISCLOSURE

Technical Problem

The present disclosure is to provide a display device capable of minimizing a flicker phenomenon in a VRR function, and a method for operating the same.

The present disclosure is to provide a display device capable of controlling local dimming to be matched to an output image in a VRR function, and a method for operating the same.

Technical Solution

A display device according to an embodiment of the present disclosure comprises a controller configured to perform a variable refresh rate (VRR) function of adjusting a screen refresh rate depending on an image signal, and a display configured to output an image depending on the screen refresh rate, wherein the controller is configured to increase the screen refresh rate adjusted depending on the image signal.

The controller multiples the screen refresh rate adjusted depending on the image signal.

The controller is configured to increase the screen refresh rate, when the screen refresh rate adjusted depending on the image signal is equal to or less than a preset frequency.

The preset frequency is 55 Hz.

The controller is configured to maintain the screen refresh rate adjusted depending on the image signal, when the screen refresh rate adjusted depending on the image signal exceeds the preset frequency.

The controller is configured to extract a frequency of a vertical synchronizing signal, based on the number of frames per second of the image signal, and increase the screen refresh rate based on the frequency of the vertical synchronizing signal.

The controller is configured to increase an operating frequency of a backlight unit provided in the display unit by increasing the screen refresh rate.

The controller is configured to apply only local dimming data, which is first calculated, to the display, when multiplying the frequency for calculating the local dimming data.

The controller is configured to prevent only local dimming data, which is second calculated, from being applied to the display, when multiplying the frequency for calculating the local dimming data.

The display device further comprising an external device interface connected to an external device, wherein the controller is configured to perform the VRR function, when receiving the image signal from the external device.

The controller includes an image decoder to acquire the number of frames per second of an image signal by decoding the image signal, and to acquire a screen refresh rate based on the number of frames per second, and a frame rate converter to increase the screen refresh rate acquired through the image decoder, and wherein the display includes a backlight unit and a backlight dimming controller driven depending on the screen refresh rate increased through the frame rate converter.

The controller is configured to increase the screen refresh rate to a second frequency higher than a first frequency, when acquiring the screen refresh rate to the first frequency, based on the image signal.

The controller is configured to fix the screen refresh rate, when the VRR function is not performed.

An operating method of a display device according to an embodiment of present disclosure comprises receiving an image signal, performing a variable refresh rate (VRR) function of adjusting a screen refresh rate depending on the image signal, increasing the screen refresh rate adjusted depending on the image signal, and outputting an image depending on the increased screen refresh rate.

Advantageous Effects

According to an embodiment of the present disclosure, the flicker phenomenon may be minimized when the VRR function is performed, thereby minimizing inconvenience of the user.

In addition, the local dimming may be applied to be matched to the output image, even when the VRR function is performed, thereby improving the contrast ratio and improving image quality.

In addition, the screen refresh rate may be increased only wider a specific condition, when the VRR function is performed. In this case, the unnecessary data processing may be minimized, thereby reducing an image processing load.

BEST MODE

Mode for Invention

Hereinafter, the present invention will be described in detail with reference to the drawings.

The suffixes "module" and "unit" for components used in the description below are assigned or mixed in consideration of easiness in writing the specification and do not have distinctive meanings or roles by themselves.

Terms including ordinal numbers such as first and second may be used to describe various elements, but the elements are not limited by the terms. The terms are only used for the purpose of distinguishing one component from another component.

The singular expression includes the plural expression unless the context clearly dictates otherwise.

In the present application, terms such as "comprises" or "have" are intended to designate that a feature, number, step, operation, component, part, or combination thereof described in the specification exists, but one or more other features It should be understood that this does not preclude the existence or addition of numbers, steps, operations, components, parts, or combinations thereof.

Figure 1:
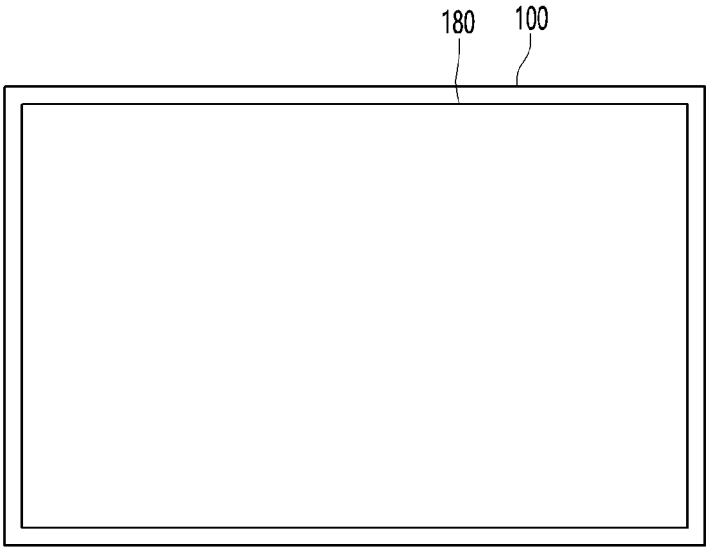
FIG. 1 is a diagram illustrating a display device according to an embodiment of the present invention.

FIG. 1 is a diagram illustrating a display device according to an embodiment of the present invention.

With reference to the drawings, a display device 100 includes a display 180.

On the other hand, the display 180 is realized by one among various panels. For example, the display 180 is one of the following panels: a liquid crystal display panel (LCD panel), an organic light-emitting diode (OLED) panel (OLED panel), and an inorganic light-emitting diode (OLED) panel (IUD panel).

According to the present disclosure, the display 180 includes a liquid crystal display panel (LCD panel). Hereinafter, the display device 100 may be a liquid crystal display device.

On the other hand, examples of the display device 100 in FIG. 1 include a monitor, a TV, a tablet PC, a mobile terminal, and so on.

Figure 2:
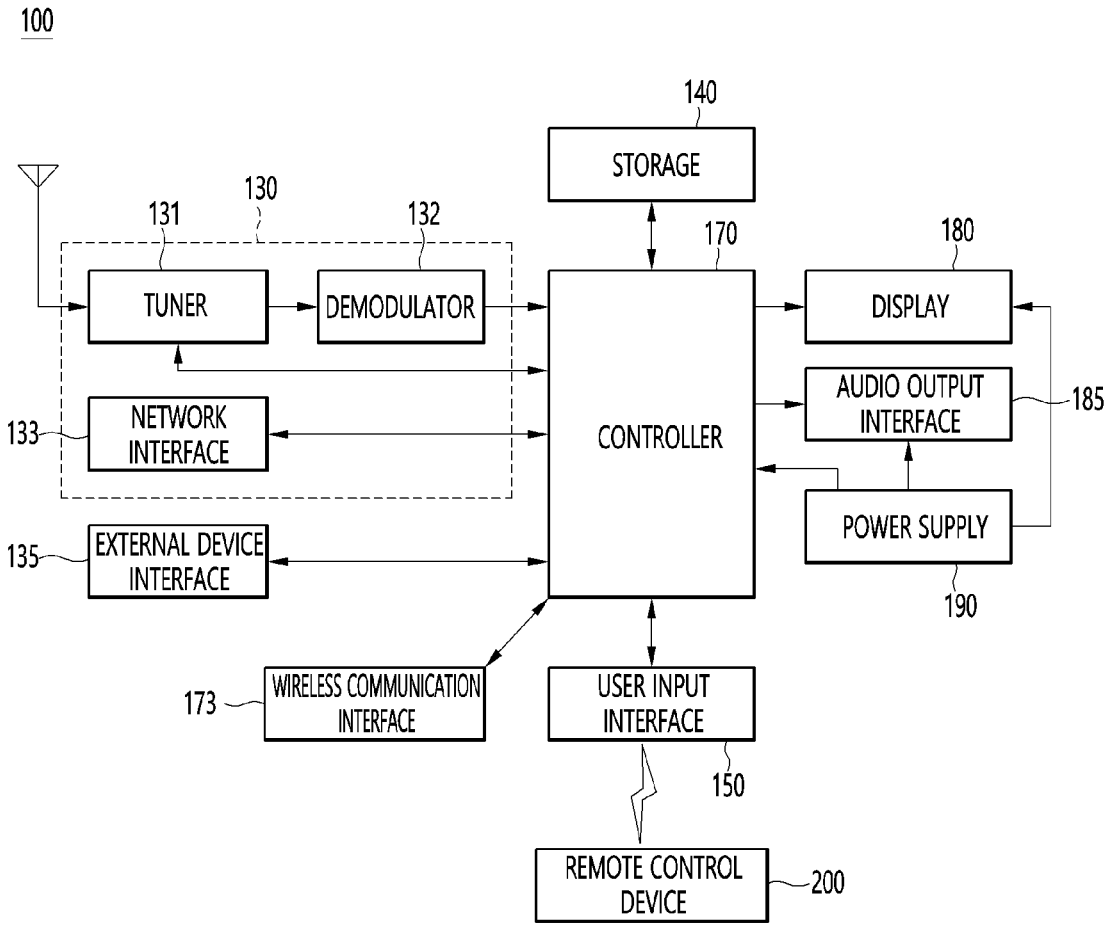
FIG. 2 is a block diagram illustrating the configuration of the display device of FIG. 1.

FIG. 2 is a block diagram illustrating the configuration of the display device of FIG. 1.

Referring to FIG. 2, a display device 100 can include a broadcast reception module 130, an external device interface 135, a storage 140, a user input interface 150, a controller 170, a wireless communication interface 173, a display 180, an audio output interface 185, and a power supply 190.

The broadcast reception module 130 can include a tuner 131, a demodulator 132, and a network interface 133.

The tuner 131 can select a specific broadcast channel according to a channel selection command. The tuner 131 can receive broadcast signals for the selected specific broadcast channel.

The demodulator 132 can divide the received broadcast signals into video signals, audio signals, and broadcast program related data signals and restore the divided video signals, audio signals, and data signals to an output available form.

The network interface 133 can provide an interface for connecting the display device 100 to a wired/wireless network including internet network. The network interface 133 can transmit or receive data to or from another user or another electronic device through an accessed network or another network linked to the accessed network.

The network interface 133 can access a predetermined webpage through an accessed network or another network linked to the accessed network. That is, it can transmit or receive data to or from a corresponding server by accessing a predetermined webpage through network.

Then, the network interface 133 can receive contents or data provided from a content provider or a network operator. That is, the network interface 133 can receive contents such as movies, advertisements, games, VODs, and broadcast signals, which are provided from a content provider or a network provider, through network and information relating thereto.

Additionally, the network interface 133 can receive firmware update information and update files provided from a network operator and transmit data to an interact or content provider or a network operator.

The network interface 133 can select and receive a desired application among applications open to the air, through network.

The external device interface 135 can receive an application or an application list in an adjacent external device and deliver it to the controller 170 or the storage 140.

The external device interface 135 can provide a connection path between the display device 100 and an external device. The external device interface 135 can receive at least one of image and audio outputted from an external device that is wirelessly or wiredly connected to the display device 100 and deliver it to the controller. The external device interface 135 can include a plurality of external input terminals. The plurality of external input terminals can include an RGB terminal, at least one High Definition Multimedia Interface (HDMI) terminal, and a component terminal.

An image signal of an external device inputted through the external device interface 135 can be outputted through the display 180. A sound signal of an external device inputted through the external device interface 135 can be outputted through audio output interface 185.

An external device connectable to the external device interface 135 can be one of a set-top box, a Blu-ray player, a DVD player, a game console, a sound bar, a smartphone, a PC, a USB Memory, and a home theater system but this is just exemplary.

Additionally, some content data stored in the display device 100 can be transmitted to a user or an electronic device, which is selected from other users or other electronic devices pre-registered in the display device 100.

The storage 140 can store signal-processed image, voice, or data signals stored by a program in order for each signal processing and control in the controller 170.

Additionally, the storage 140 can perform a function for temporarily store image, voice, or data signals outputted from the external device interface 135 or the network interface 133 and can store information on a predetermined image through a channel memory function.

The storage 140 can store an application or an application list inputted from the external device interface 135 or the network interface 133.

The display device 100 can play content files (for example, video files, still image files, music files, document files, application files, and so on) stored in the storage 140 and provide them to a user.

The user input interface 150 can deliver signals inputted from a user to the controller 170 or deliver signals from the controller 170 to a user. For example, the user input interface 150 can receive or process control signals such as power on/off, channel selection, and screen setting from the remote control device 200 or transmit control signals from the controller 170 to the remote control device 200 according to various communication methods such as Bluetooth, Ultra Wideband (WB), ZigBee, Radio Frequency (RF), and IR.

Additionally, the user input interface 150 can deliver, to the controller 170, control signals inputted from local keys (not shown) such as a power key, a channel key, a volume key, and a setting key.

Image signals that are image-processed in the controller 170 can be inputted to the display 180 and displayed as an image corresponding to corresponding image signals. Additionally, image signals that are image-processed in the controller 170 can be inputted to an external output device through the external device interface 135.

Voice signals processed in the controller 170 can be outputted to the audio output interface 185. Additionally, voice signals processed in the controller 170 can be inputted to an external output device through the external device interface 135.

Besides that, the controller 170 can control overall operations in the display device 100.

Additionally, the controller 170 can control the display device 100 by a user command or internal program inputted through the user input interface 150 and download a desired application or application list into the display device 100 in access to network.

The controller 170 can output channel information selected by a user together with processed image or voice signals through the display 180 or the audio output interface 185.

Additionally, according to an external device image playback command received through the user input interface 150, the controller 170 can output image signals or voice signals of an external device such as a camera or a camcorder, which are inputted through the external device interface 135, through the display 180 or the audio output interface 185.

Moreover, the controller 170 can control the display 180 to display images and control broadcast images inputted through the tuner 131, external input images inputted through the external device interface 135, images inputted through the network interface, or images stored in the storage 140 to be displayed on the display 180. In this case, an image displayed on the display 180 can be a still image or video and also can be a 2D image or a 3D image.

Additionally, the controller 170 can play content stored in the display device 100, received broadcast content, and external input content inputted from the outside, and the content can be in various formats such as broadcast images, external input images, audio files, still images, accessed web screens, and document files.

Moreover, the wireless communication interface 173 can perform a wired or wireless communication with an external electronic device. The wireless communication interface 173 can perform short-range communication with an external device. For this, the wireless communication interface 173 can support short-range communication by using at least one of Bluetooth™, Radio Frequency identification (RFID), Infrared Data Association (IrDA), Ultra Wideband (UWB), ZigBee, Near Field Communication (NFC), Wireless-Fidelity (Wi-Fi), Direct, and Wireless Universal Serial Bus (USB) technologies. The wireless communication interface 173 can support wireless communication between the display device 100 and a wireless communication system, between the display device 100 and another display device 100, or between networks including the display device 100 and another display device 100 (or an external server) through wireless area networks. The wireless area networks can be wireless personal area networks.

Herein, the other display device 100 can be a mobile terminal such as a wearable device (for example, a smart watch, a smart glass, and a head mounted display (HMD)) or a smartphone, which is capable of exchanging data (or inter-working) with the display device 100. The wireless communication interface 173 can detect (or recognize) a communicable wearable device around the display device 100. Furthermore, if the detected wearable device is a device authenticated to communicate with the display device 100, the controller 170 can transmit at least part of data processed in the display device 100 to the wearable device through the wireless communication interface 173. Accordingly, a user of the wearable device can use the data processed in the display device 100 through the wearable device.

The display 180 can convert image signals, data signals, or OSD signals, which are processed in the controller 170, or images signals or data signals, which are received in the external device interface 135, into R, G, and B signals to generate driving signals.

Furthermore, the display device 100 shown in FIG. 2 is just one embodiment of the present disclosure and thus, some of the components shown can be integrated, added, or omitted according to the specification of the actually implemented display device 100.

That is, if necessary, two or more components can be integrated into one component or one component can be divided into two or more components and configured. Additionally, a function performed by each block is to describe an embodiment of the present disclosure and its specific operation or device does not limit the scope of the present disclosure.

According to another embodiment of the present disclosure, unlike FIG. 2, the display device 100 can receive images through the network interface 133 or the external device interface 135 and play them without including the tuner 131 and the demodulator 132.

For example, the display device 100 can be divided into an image processing device such as a set-top box for receiving broadcast signals or contents according to various network services and a content playback device for playing contents inputted from the image processing device.

In this case, an operating method of a display device according to an embodiment of the present disclosure described below can be performed by one of the display device described with reference to FIG. 2, an image processing device such as the separated set-top box, and a content playback device including the display 180 and the audio output interface 185.

The audio output interface 185 receives a signal which is voice-processed by the controller 170.

A power supply 190 supplies relevant power throughout the display device 100. In particular, the power supply 190 may supply power to the controller 170, which is implemented in the form of a system on chip (SoC), the display 180 to display an image, and the audio output interface 185 for an audio output.

In detail, the power supply 190 may include a converter, which converts alternating current (AC) power to direct current (DC) power, and a dc/dc converter which converts the level of the DC power.

The remote controller 200 transmits a user input to a user input interface 150. To this end, the remote controller 200 may employ Bluetooth, radio frequency (RF) communication, infrared communication, ultra wideband, or ZigBee. Alternatively, the remote controller 200 may receive an image, a voice, or a data signal output from the user input interface 150, may display the image, the voice, or the data signal to the remote controller 200, and may output voice.

Figure 3:
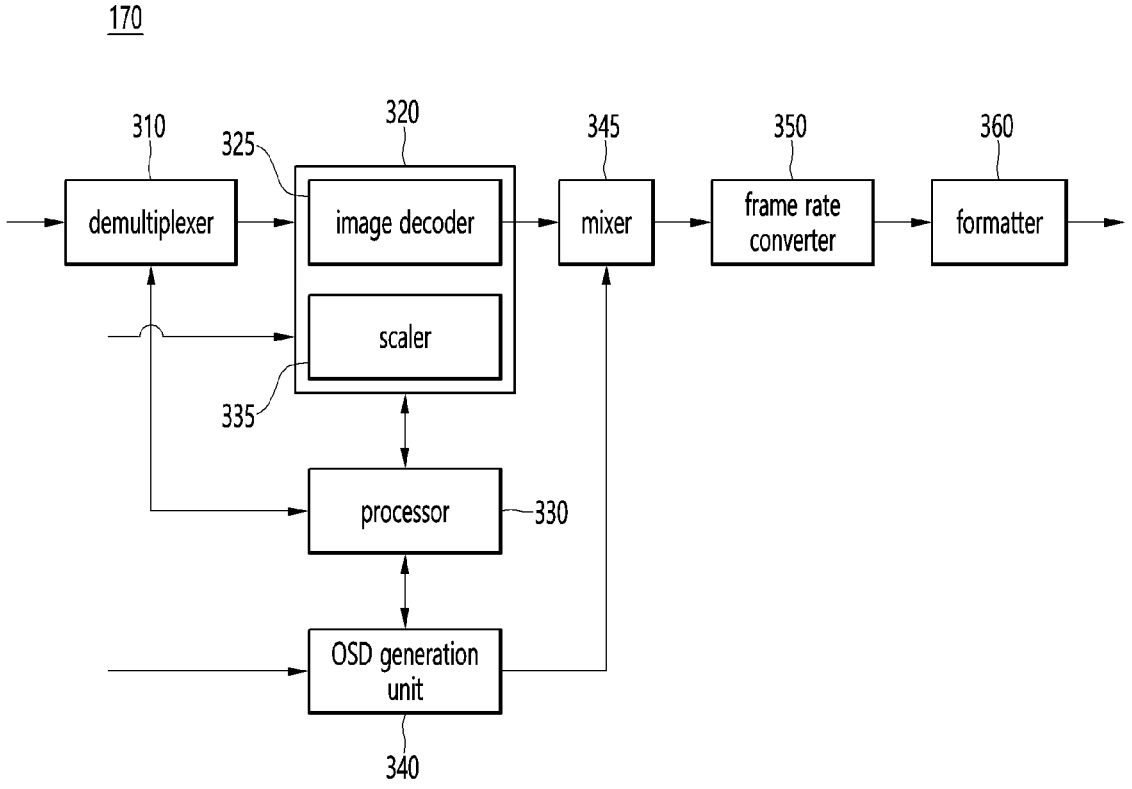
FIG. 3 is an example of a block diagram of the inside of a controller in FIG. 2.

FIG. 3 is an example of a block diagram of the inside of a controller in FIG. 2.

For description with reference to the drawings, the controller 170 according to an embodiment of the present invention includes a demultiplexer 310, an image processing unit 320, a processor 330, an OSD generation unit 340, a mixer 345, a frame rate converter 350, and a formatter 360. In addition, an audio processing unit (not illustrated) and a data processing unit (not illustrated) are further included.

The demultiplexer 310 demultiplexes a stream input. For example, in a case where an MPEG-2 TS is input, the MPEG-2 TS is demultiplexed into an image signal, an audio signal, and a data signal. At this point, a stream signal input into the demultiplexer 310 is a stream signal output from the tuner 131, the demodulator 132, or the external device interface 135.

The image processing unit 320 performs image processing of the image signal that results from the demultiplexing. To do this, the image processing unit 320 includes an image decoder 325 or a scaler 335.

The image decoder 325 decodes the image signal that results from the demultiplexing. The scaler 335 performs scaling in such a manner that a resolution of an image signal which results from the decoding is such that the image signal is possibly output to the display 180.

Examples of the image decoder 325 possibly include decoders in compliance with various specifications. For example, the examples of the image decoder 325 include a decoder for MPEG-2, a decoder for H.264, a 3D image decoder for a color image and a depth image, a decoder for a multi-point image, and so on.

The processor 330 controls an overall operation within the display device 100 or within the controller 170. For example, the processor 330 controls the tuner unit 110 in such a manner that the tuner unit 110 performs the selection of (tuning to) the RF broadcast that corresponds to the channel selected by the user or the channel already stored.

In addition, the processor 330 controls the display device 100 using the user command input through the user input interface 150, or the internal program.

In addition, the processor 330 performs control of transfer of data to and from the network interface 133 or the external device interface 135.

In addition, the processor 330 controls operation of each of the demultiplexer 310, the image processing unit 320, the OSD generation unit 340, and so on within the controller 170.

The OSD generation unit 340 generates an OSD signal, according to the user input or by itself. For example, based on the user input signal, a signal is generated for displaying various pieces of information in a graphic or text format on a screen of the display 180. The OSD signal generated includes various pieces of data for a user interface screen of the display device 100, various menu screens, a widget, an icon, and so on. In addition, the OSD generated signal includes a 2D object or a 3D object.

In addition, based on a pointing signal input from the remote controller 200, the OSD generation unit 340 generates a pointer possibly displayed on the display. Particularly, the pointer is generated in a pointing signal processing unit, and an OSD generation unit 340 includes the pointing signal processing unit (not illustrated). Of course, it is also possible that instead of being providing within the OSD generation unit 340, the pointing signal processing unit (not illustrated) is provided separately.

The mixer 345 mixes the OSD signal generated in the OSD generation unit 340, and the image signal that results from the image processing and the decoding in the image processing unit 320. An image signal that results from the mixing is provided to the frame rate converter 350.

The frame rate converter (FRC) 350 converts a frame rate of an image input. On the other hand, it is also possible that the frame rate converter 350 outputs the image, as is, without separately converting the frame rate thereof.

On the other hand, the formatter 360 converts a format of the image signal input, into a format for an image signal to be displayed on the display, and outputs an image that results from the conversion of the format thereof.

The formatter 360 changes the format of the image signal. For example, a format of a 3D image signal is changed to any one of the following various 3D formats: a side-by-side format, a top and down format, a frame sequential format, an interlaced format, and a checker box format.

On the other hand, the audio processing unit (not illustrated) within the controller 170 performs audio processing of an audio signal that results from the demultiplexing. To do this, the audio processing unit (not illustrated) includes various decoders.

In addition, the audio processing unit (not illustrated) within the controller 170 performs processing for base, treble, volume adjustment and so on.

The data processing unit (not illustrated) within the controller 170 performs data processing of a data signal that results from the demultiplexing. For example, in a case where a data signal that results from the demultiplexing is a data signal the results from coding, the data signal is decoded. The data signal that results from the coding is an electronic program guide that includes pieces of broadcast information, such as a starting time and an ending time for a broadcast program that will be telecast in each channel.

On the other hand, a block diagram of the controller 170 illustrated in FIG. 3 is a block diagram for an embodiment of the present invention. Each constituent element in the block diagram is subject to integration, addition, or omission according to specifications of the image display controller 170 actually realized.

Particularly, the frame rate converter 350 and the formatter 360 may be provided separately independently of each other or may be separately provided as one module, without being provided within the controller 170.

Figure 4A:
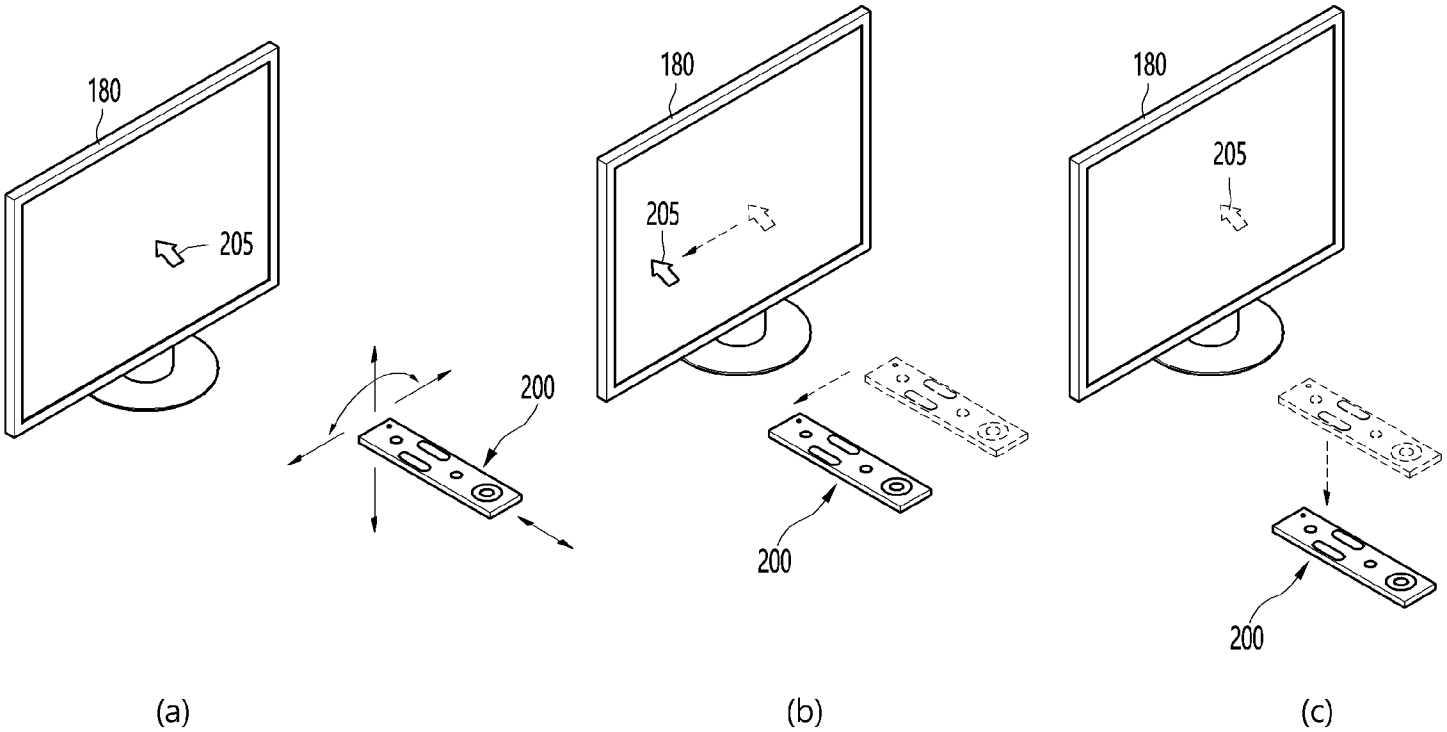
FIG. 4A is a diagram illustrating a method in which the remote controller in FIG. 2 performs control.

FIG. 4A is a diagram illustrating a method in which the remote controller in FIG. 2 performs control.

In FIG. 4A(a), it is illustrated that a pointer 205 which corresponds to the remote controller 200 is displayed on the display 180.

The user moves or rotates the remote controller 200 upward and downward, leftward and rightward (FIG. 4A(b)), and forward and backward (FIG. 4A(c)). The pointer 205 displayed on the display 180 of the display device corresponds to movement of the remote controller 200. As in the drawings, movement of the pointer 205, which depends on the movement of the remote controller 200 in a 3D space, is displayed and thus, the remote controller 200 is named a spatial remote controller or a 3D pointing device.

FIG. 4A(b) illustrates that, when the user moves the remote controller 200 leftward, the pointer 205 displayed on the display 180 of the display device correspondingly moves leftward.

Information on the movement of the remote controller 200, which is detected through a sensor of the remote controller 200, is transferred to the display device. The display device calculates the information on the movement of the remote controller 200 from coordinates of the pointer 205. The display device displays the pointer 205 in such a manner that the pointer 25 corresponds to the calculated coordinates.

FIG. 4A(c) illustrates a case where the user moves the remote controller 200 away from the display 180 in a state where a specific button within the remote controller 200 is held down. Accordingly, a selection area within the display 180, which corresponds to the pointer 205, is zoomed in so that the selection area is displayed in an enlarged manner. Conversely, in a case where the user causes the remote controller 200 to approach the display 180, the selection area within the display 180, which corresponds to the pointer 205, is zoomed out so that the selection is displayed in a reduced manner. On the other hand, in a case where the remote controller 200 moves away from the display 180, the selection area may be zoomed out, and in a case where the remote controller 200 approaches the display 180, the selection area may be zoomed in.

On the other hand, an upward or downward movement, or a leftward or rightward movement is not recognized in a state where a specific button within the remote controller 200 is held down. That is, in a case where the remote controller 200 moves away from or approaches the display 180, only a forward or backward movement is set to be recognized without the upward or downward movement, or the leftward or rightward movement being recognized. Only the pointer 205 moves as the remote controller 200 moves upward, downward, leftward, or rightward, in a state where a specific button within the remote controller 200 is not held down.

On the other hand, a moving speed or a moving direction of the pointer 205 corresponds to a moving speed or a moving direction of the remote controller 200, respectively.

Figure 4B:
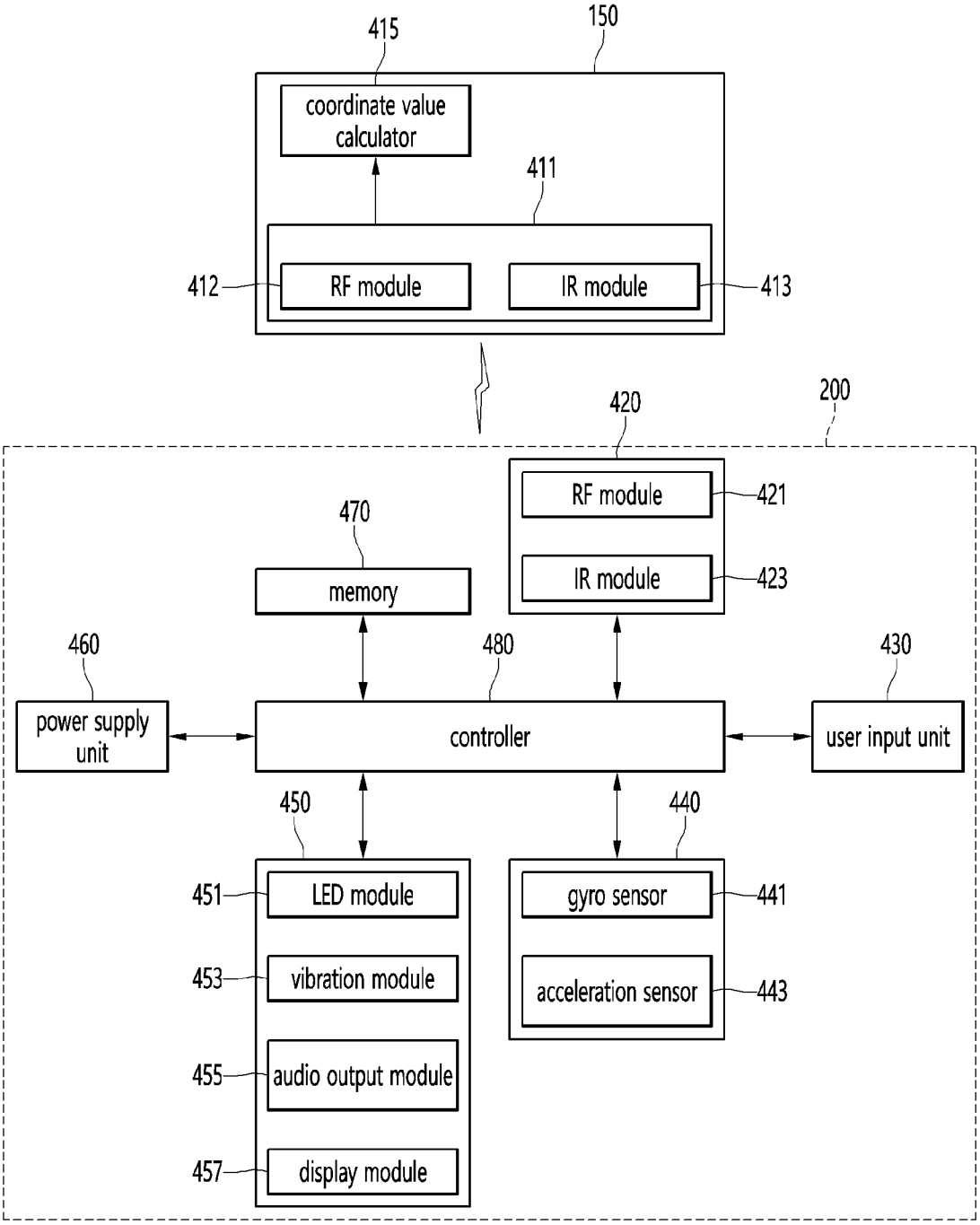
FIG. 4B is a block diagram of the inside of the remote controller in FIG. 2.

FIG. 4B is a block diagram of the inside of the remote controller in FIG. 2.

For description with reference to the drawings, the remote controller 200 includes a wireless communication unit 420, a user input unit 430, a sensor unit 440, an output unit 450, a power supply unit 460, a memory 470, and a controller 480.

The wireless communication unit 420 transmits and receives a signal to and from an arbitrary one of the display devices according to the embodiments of the present invention, which are described above. Of the display devices according to the embodiments of the present invention, one display device is taken as an example for description.

According to the present embodiment, the remote controller 200 includes an RF module 421 that transmits and receives a signal to and from the display device 100 in compliance with RF communication standards. In addition, the remote controller 200 includes an IR module 423 that possibly transmits and receives a signal to and from the display device 100 in compliance with IR communication standards.

According to the present embodiment, the remote controller 200 transfers a signal containing information on the movement of the remote controller 200 to the display device 100 through the RF module 421.

In addition, the remote controller 200 receives a signal transferred by the display device 100, through the RF module 421. In addition, the remote controller 200 transfers a command relating to power-on, power-off, a channel change, or a volume change, to the display device 100, through the IR module 423, whenever needed.

The user input unit 430 is configured with a keypad, buttons, a touch pad, a touch screen, or so on. The user inputs a command associated with the display device 100 into the remote controller 200 by operating the user input unit 430. In a case where the user input unit 430 is equipped with a physical button, the user inputs the command associated with the display device 100 into the remote controller 200 by performing an operation of pushing down the physical button. In a case where the user input unit 430 is equipped with a touch screen, the user inputs the command associated with the display device 100 into the remote controller 200 by touching on a virtual key of the touch screen. In addition, the user input unit 430 may be equipped with various types of input means operated by the user, such as a scroll key or a jog key, and the present embodiment does not impose any limitation on the scope of the present invention.

The sensor unit 440 includes a gyro sensor 441 or an acceleration sensor 443. The gyro sensor 441 senses information on the movement of the remote controller 200.

As an example, the gyro sensor 441 senses the information on operation of the remote controller 200 on the x-, y-, and z-axis basis. The acceleration sensor 443 senses information on the moving speed and so on of the remote controller 200. On the other hand, a distance measurement sensor is further included. Accordingly, a distance to the display 180 is sensed.

The output unit 450 outputs an image or an audio signal that corresponds to the operating of the user input unit 430 or corresponds to a signal transferred by the display device 100. Through the output unit 450, the user recognizes whether or not the user input unit 430 is operated or whether or not the display device 100 is controlled.

As an example, the output unit 450 includes an LED module 451, a vibration module 453, an audio output module 455, or a display module 457. The LED module 451, the vibration module 453, the audio output module 455, and the display module 457 emits light, generates vibration, outputs audio, or outputs an image, respectively, when the input unit 435 is operated, or a signal is transmitted and received to and from the display device 100 through a wireless communication unit 420.

The power supply unit 460 supplies a power to the remote controller 200. In a case where the remote controller 200 does not move for a predetermined time, the power supply unit 460 reduces power consumption by interrupting power supply. In a case where a predetermined key provided on the remote controller 200 is operated, the power supply unit 460 resumes the power supply.

Various types of programs, pieces of application data, and so on that are necessary for control or operation of the remote controller 200 are stored in the memory 470. In a case where the remote controller 200 transmits and receives a signal to and from the display device 100 in a wireless manner through the RF module 421, the signal is transmitted and received in a predetermined frequency hand between the remote controller 200 and the display device 100. The controller 480 of the remote controller 200 stores information on, for example, a frequency band in which data is transmitted and received in a wireless manner to and from the display device 100 paired with the remote controller 200, in the memory 470, and makes a reference to the stored information.

The controller 480 controls all operations associated with the control by the remote controller 200. The controller 480 transfers a signal that corresponds to operating of a predetermined key of the user input unit 430, or a signal that corresponds to the movement of the remote controller 200, which is sensed in the sensor unit 440, to the display device 100 through the wireless communication unit 420.

A user input interface 150 of the display device 100 includes a wireless communication unit 411 that transmits and receives a signal in a wireless manner to and from the remote controller 200, and a coordinate value calculator 415 that calculates a coordinate value of the pointer, which corresponds to the operation of the remote controller 200.

The user input interface 150 transmits and receives the signal in a wireless manner to and from the remote controller 200 through the RF module 412. In addition, a signal transferred in compliance with the IR communication standards by the remote controller 200 through the IR module 413 is received.

The coordinate value calculator 415 calculates a coordinate value (x, y) of the pointer 205 to be displayed on the display 180, which results from compensating for a hand movement or an error, from a signal that corresponds to the operation of the remote controller 200, which is received through the wireless communication unit 411.

A transfer signal of the remote controller 200, which is input into the display device 100 through the user input interface 150 is transferred to the controller 170 of the display device 100. The controller 170 determines information on the operation of the remote controller 200 and information on operating of a key, from the signal transferred by the remote controller 200, and correspondingly controls the display device 100.

As another example, the remote controller 200 calculates a coordinate value of a pointer, which corresponds to the operation of the remote controller 200, and outputs the calculated value to the user input interface 150 of the display device 100. In this case, the user input interface 150 of the display device 100 transfers information on the received coordinate values of the pointer, to the controller 170, without performing a process of compensating for the hand movement and the error.

In addition, as another example, unlike in the drawings, it is also possible that the coordinate value calculator 415 is included within the controller 170 instead of the user input interface 150.

Figure 5:
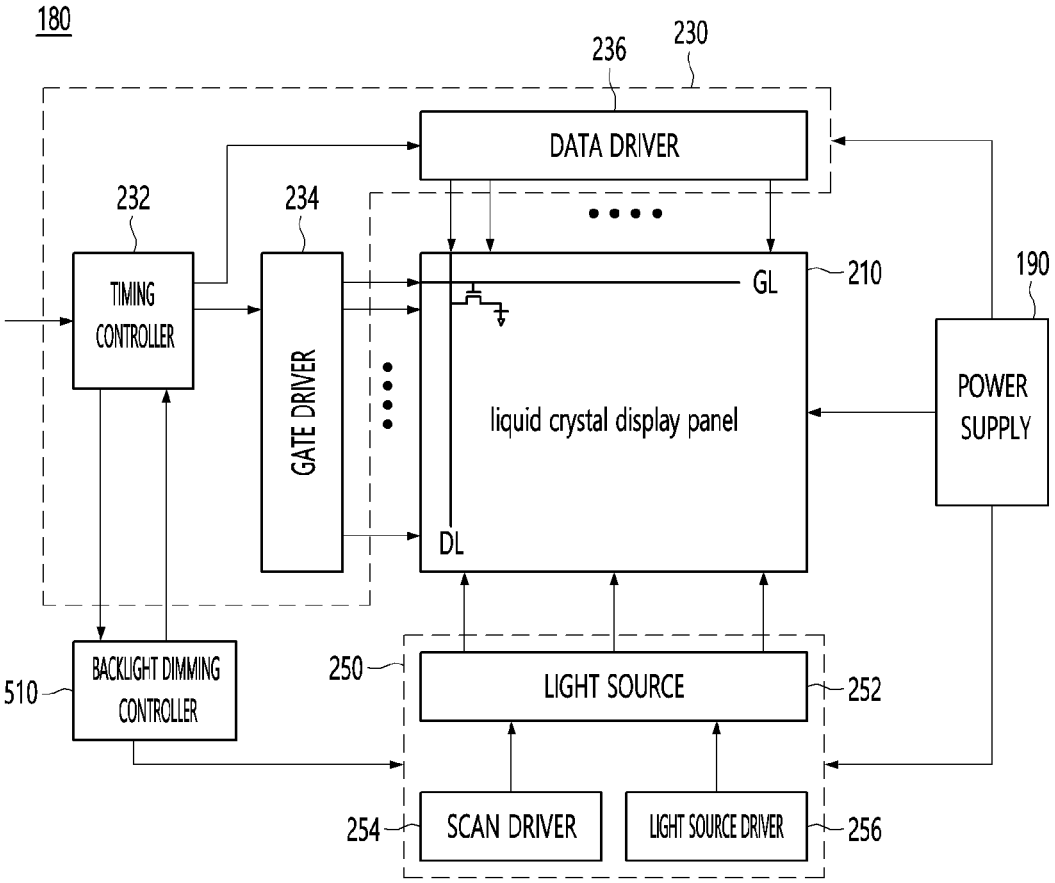
FIG. 5 is a block diagram illustrating an inner part of the power supply and the display of FIG. 2.

FIG. 5 is a block diagram illustrating an inner part of the power supply and the display of FIG. 2.

Referring to drawings, the display module 180 based on a liquid crystal panel (LCD) panel may include a liquid crystal display panel 210, a driving circuit 230, a backlight unit 250, an a backlight dimming controller 510.

The liquid crystal panel 210 has a plurality of gate lines GL and data lines DL crossing each other in a matrix form, and includes a first substrate, in which a thin film transistor and a pixel electrode connected to the thin film transistor are formed at the crossing area, a second substrate including a common electrode, and a liquid crystal layer interposed between the first substrate and the second substrate.

The driving circuit 230 drives the liquid crystal display panel 210 based on a control signal and a data signal supplied from the controller 170 of FIG. 1. To this end, the driving circuit 230 includes a tinting controller 232, a gate driver 234, and a data driver 236.

The timing controller 232 receives the control signal and an R, G, and B signals, and a vertical synchronization (Vsync) signal from the controller 170 to control the gate driver 234 and the data driver 236, in response to the control signal, re-arranges the R, G, and B data signals, and provides the R, G, and B signals to the data driver 236.

A scan signal and an image signal are supplied to the liquid crystal display panel 210 through the gate line GL and the data line DL, in response to the control of the gate driver 234, the data driver 236, and the timing controller 232.

The backlight unit 250 supplies light to the liquid crystal display panel 210. To this end, the backlight unit 250 may include a plurality of light sources 252, a scan driver 254, which controls the scanning driving of the light source 252, and a light source driver 256 which turns On/Off the light source 252.

A specific image is displayed by using light output from the backlight unit 250, in the state that the light transmittance of the liquid crystal layer is adjusted by an electric generated formed between a pixel electrode and a common electrode of the liquid crystal display panel 210.

The power supply 190 may supply a common electrode voltage Vcom to the liquid crystal panel 210, and may supply a gamma voltage to the data driver 236. In addition, driving power may be supplied to the backlight unit 250 to drive the light source 252.

Meanwhile, the backlight unit 250 is divided into a plurality of blocks for driving. The controller 170 may control the display 180 to perform local dimming by setting a dimming value for each of the plurality of blocks. In detail, the timing controller 232 may output input image data RGB to the backlight dimming controller 510, and the backlight dimming controller 510 may calculate the dimming value of each of the plurality of blocks, based on the input image data RGB received from the timing controller 232.

Figure 6:
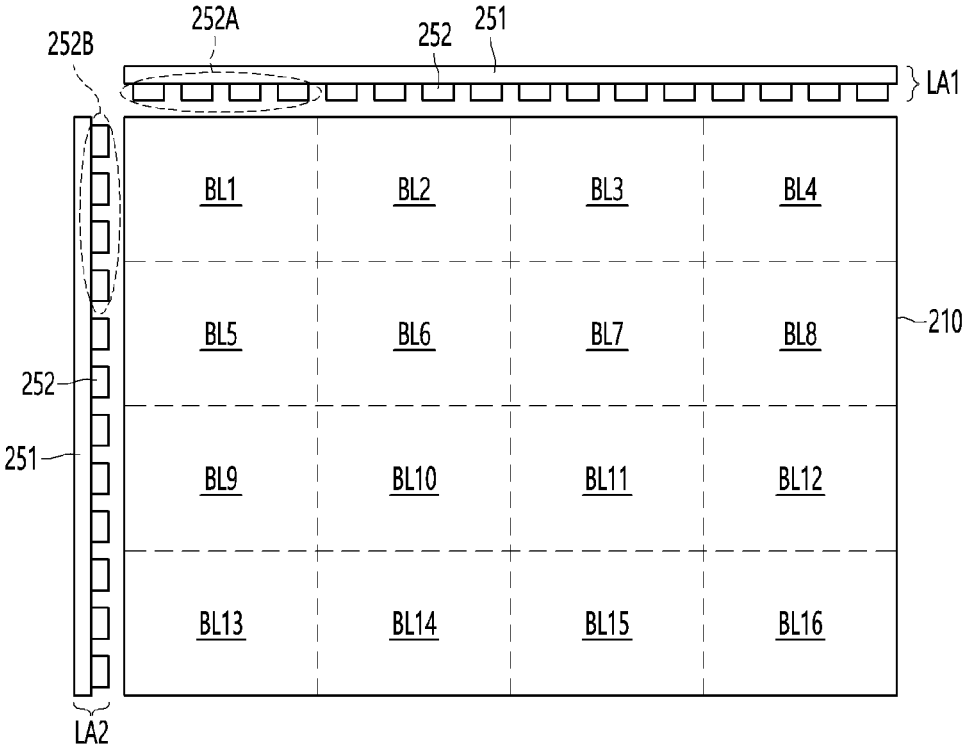
FIG. 6 is a view illustrating a liquid crystal display panel and the arrangement of light sources in the case of an edge type backlight unit.
Figure 7:
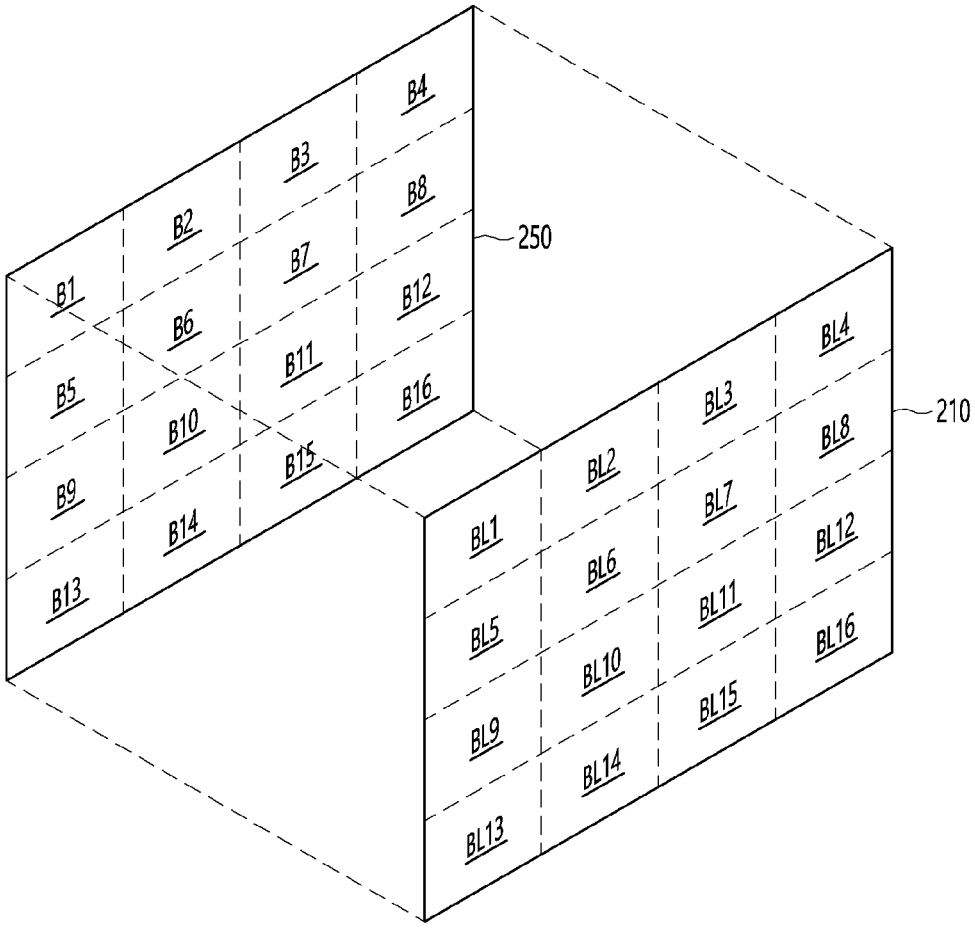
FIG. 7 is a view illustrating a liquid crystal display panel and the arrangement of light sources in the case of a direct type backlight unit.

FIG. 6 is a view illustrating a liquid crystal display panel and the arrangement of light sources in the case of an edge type backlight unit, and FIG. 7 is a view illustrating a liquid crystal display panel and the arrangement of light sources in the case of a direct type backlight unit.

The liquid crystal display panel 210 may be divided into a plurality of virtual blocks as illustrated in FIGS. 6 and 7. Although FIGS. 6 and 7 illustrate that the liquid crystal display panel 210 is uniformly divided into 16 blocks BL1 to BL16, the present disclosure is not limited thereto. Each of the plurality of blocks may include a plurality of pixels.

The backlight unit 250 may be implemented in one of an edge type and a direct type.

The edge type backlight unit 250 has a structure in which a plurality of optical sheets and a light guide plate are stacked under the liquid crystal display panel 210, and a plurality of light sources are arranged on a side surface of the light guide plate. When the backlight unit 250 is implemented as an edge type backlight unit, the light sources are disposed on at least one of top and bottom surfaces of the liquid crystal display panel 210 and on at least one of left and right side surfaces of the liquid crystal display panel 210. FIG. 6 illustrates that a first light source array LA1 is disposed on the top surface of the liquid crystal display panel 210 and a second light source array LA2 is disposed on the left side surface of the liquid crystal display panel 210. Each of the first light source array LA1 and the second light source array LA2 includes a plurality of light sources 252 and a light circuit board 251 on which the light sources 252 are mounted. In this case, the brightness of light incident onto a first block BL1 of the liquid crystal display panel 210 may be adjusted by using light sources 252A of the first light source array LA1 and light sources 252B of the second light source array LA2, which are positioned to correspond to the first block BL1 of the liquid crystal display panel 210.

The direct type backlight unit 250 has a structure in which a plurality of optical sheets and a diffusion plate are stacked under the liquid crystal display panel 210 and a plurality of light sources are disposed under the diffusion plate. When the backlight unit 250 is implemented as the direct type backlight unit, the backlight unit 250 is divided to one-to-one correspond to the blocks BL1 to BL16 of the liquid crystal display panel 210 as illustrated in FIG. 7. In this case, the brightness of light incident onto the first block BL1 of the liquid crystal display panel 210 may be adjusted by using the light sources 252 included in the first block B1 of the backlight unit 250, which is disposed at a position corresponding to the first block BL1 of the liquid crystal display panel 210.

The light sources 252 may be implemented as point light sources such as a light emitting diode (LED). The light sources 252 are turned on and off by receiving light source driving signals LDS from the light source driver 256. The intensity of light of the light sources 252 may be adjusted depending on the amplitudes of the light source driving signals LDS, and a lighting duration may be adjusted depending on a pulse width. The brightness of light output from the light sources 252 may be adjusted depending on the light source driving signals LDS.

The light source driver 256 may generate the light source driving signals LDS, based on a dimming value of each of the blocks, which is input from the backlight dimming controller 510 and output the generated dimming signals LDS to the light source 252. The dimming values of the blocks may be values for implementing local dimming and may be brightness of light output from the light sources 252.

The controller 170 may perform a variable refresh rate (VRR) function.

The VRR function may be a function of adjusting a refresh rate of a screen depending on an image signal.

The screen refresh rate may refer to the number of frequencies in which the display 180 displays a frame for one second. In other words, the refresh rate of the screen may be a numerical value indicating the number of scenes output by the display 180 for one second.

The screen refresh rate may be a scan rate or a screen refresh rate.

The controller 170 may perform the VRR function under a specific condition. For example, the controller 170 may perform the VRR function in the game mode. In addition, the controller 170 may perform the VRR function, when receiving an image signal from an external device through the external device interface 135. In addition, the controller 170 may perform the VRR function, when determining a frame per second (FPS) of the image signal as not being constant, based on a processing result of the image signal. Alternatively, the controller 170 may perform the VRR function, when receiving a command for performing the VRR function through the user input interface 150. However, the above cases are provided for the illustrative purpose, and the controller 170 may perform the VRR function in various manners.

The controller 170 may acquire a vertical synchronizing signal, based on the image signal while performing the VRR function. In other words, the controller 170 may extract the vertical synchronizing signal Vsync by decoding the image signal.

The vertical synchronizing signal may be a signal for matching a starting point to scan one field in a transmitter and a receiver.

The controller 170 may acquire a vertical synchronizing signal having a constant frequency, when the controller 170 does not perform the VRR function. Accordingly, in this case, the screen refresh rate may be constant, and the number of frames, which are displayed by the display 180 per second may be constant. For example, the controller 170 may display 60 frames per second, when the VRR function is not performed.

However, the controller 170 extracts the vertical synchronizing signal, based on an image signal when performing the VRR function. In this case, the frequency of the vertical synchronizing signal may be varied depending on the number of frames of the image signal per second. Accordingly, in this case, the number of frames, which are displayed by the display 180, per second may be varied.

Figure 8:
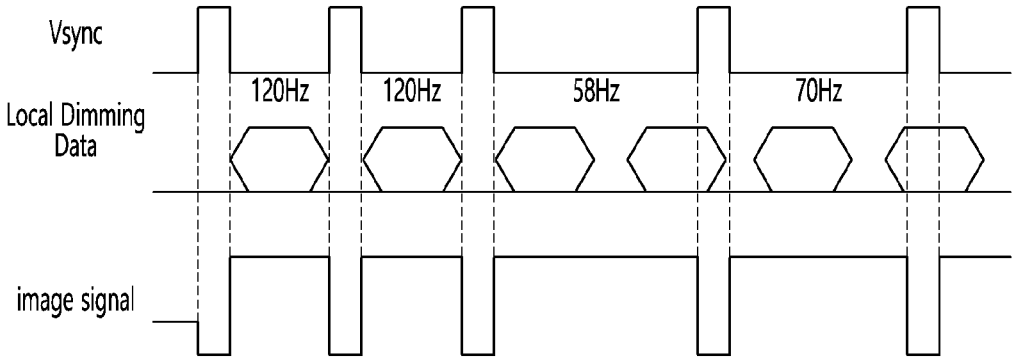
FIG. 8 is a view illustrating a method in which the display device controls a vertical synchronizing signal and local dimming, based on an image signal while performing a VRR function.

FIG. 8 is a view illustrating a method in which the display device controls a vertical synchronizing signal and local dimming, based on an image signal while performing a VRR function.

In detail, the controller 170 may extract the vertical synchronizing signal Vsync, based on an image signal, which is received, when the controller 170 is performing the VRR function and when the image signal is input.

Referring to FIG. 8, according to the result obtained by acquiring the vertical synchronizing signal based on the image signal by the controller 170, the frequency of the vertical synchronizing signal may be consecutively changed to 120 Hz, 120 Hz, 58 Hz, and 70 Hz.

When the VRR function is being executed, the frequency of the vertical synchronizing signal may be changed between about 48 Hz and 120 Hz.

In other words, the controller 170 may control the backlight unit 250 depending on the vertical synchronizing signal. In other words, the controller 170 may recognize the frequency of the vertical synchronizing signal as an operating frequency of the backlight unit 250, and the backlight unit 250 may operate depending on the vertical synchronizing signal. In this case, when the frequency of the vertical synchronizing signal is excessively low (for example, the frequency of the vertical synchronizing signal is about 55 Hz or less), a user may recognize a flicker.

In addition, in the conventional display device 100, the backlight dimming controller 510 calculates local dimming data in a specific period regardless of the vertical synchronizing signal, and controls the local dimming, based on the calculated local dimming data.

The local dimming data may refer to a dimming value of each of blocks, which is extracted based on image data for local dimming. Accordingly, the local dimming data may be varied depending on the variation of the image data.

However, as in a conventional technology, when the controller 170 calculates local dimming data in the specific period and controls local dimming, even though image data is changed, the controller 170 controls the local dimming based on local dimming data based on a previous image frame, so the contrast of an image is not enhanced or deteriorated. In other words, when the VRR function is performed, the local dimming is not sufficiently performed.

According to an embodiment of the present disclosure, the display device 100 increases a screen refresh rate adjusted depending on an image signal to improve a flicker problem, and controls local dimming depending on the adjusted/increased screen refresh rate, such that the local dimming is performed to be matched to an image even in the VRR function.

Figure 9:
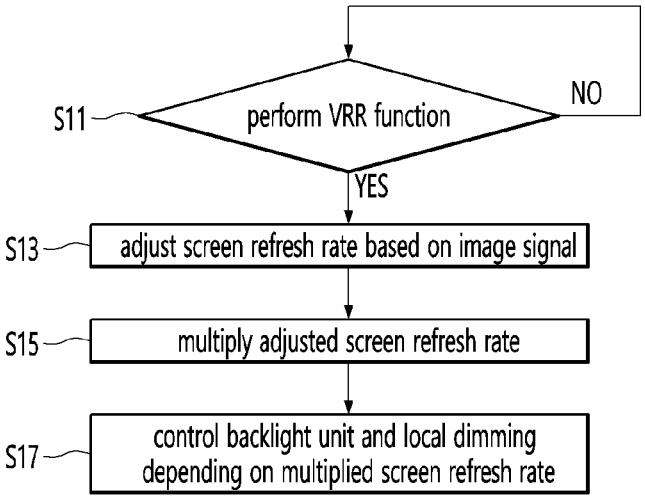
FIG. 9 is a flowchart illustrating an operating method of a display device according to an embodiment of the present disclosure.

FIG. 9 is a flowchart illustrating an operating method of a display device according to an embodiment of the present disclosure.

The controller 170 may perform the VRR function (S11).

The controller 170 may determine whether the VRR function is being performed, may fix the screen refresh rate when the VRR function is not performed, and may change the screen refresh rate depending on an image signal. Hereinafter, the above method will be described in detail.

The controller 170 may adjust the screen refresh rate based on the image signal, when the VRR function is being performed (S13).

In more detail, when the VRR function is being performed, the controller 170 may acquire the number of frames per second of the image signal and may extract the frequency of the vertical synchronizing signal, based on the number of frames per second of the image signal.

In particular, the image decoder 320 may acquire the number of frames per second of the image signal by decoding the image signal, may extract the vertical synchronizing signal based on the number of frames per second, and may acquire the screen refresh rate. The frame rate converter 350 may change a frame rate depending on the screen refresh rate acquired through the image decoder 320. In addition, the frame rate converter 350 may increase the screen fresh rate acquired by the screen image decoder 430, and may change the frame rate depending on the increased screen refresh rate when the screen refresh rate is increased.

Figure 10:
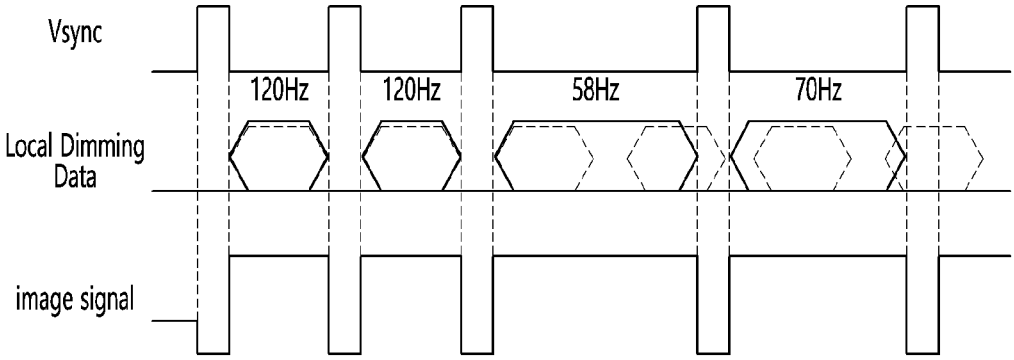
FIG. 10 is a view illustrating output timing of a vertical synchronizing signal Vsync and local dimming data depending on an image signal while a display device is performing the VRR function according to an embodiment of the present disclosure.

FIG. 10 is a view illustrating output timing of a vertical synchronizing signal Vsync and local dimming data depending on an image signal while a display device is performing the VRR function according to an embodiment of the present disclosure.

For example, the controller 170 may extract the frequency of the vertical synchronizing signal as 120 Hz when the number of frames per second of the image signal is 120, may extract the frequency of the vertical synchronizing signal as 58 Hz, when the number of frames per second of the image signal is 58, and may extract the frequency of the vertical synchronizing signal as 70 Hz, when the number of frames per second of the signal is 70.

The controller 170 may adjust the screen refresh rate depending on the frequency of the vertical synchronizing signal.

The screen refresh rate may refer to the number of frames, which is displayed by the display 180, for one second, and the unit of the screen refresh rate may be hertz (Hz) referring to repetition per second. Accordingly, the screen refresh rate may be the frequency of the vertical synchronizing signal.

Accordingly, the controller 170 may adjust the screen refresh rate depending on the number of frames per second of the image signal. For example, the controller 170 may adjust the screen refresh rate as 120 Hz, when the number of frames per second of the image signal is 120, may adjust the screen refresh rate as 58 Hz, when the number of frames per second of the image signal is 58, and may adjust the screen refresh rate as 70 Hz, when the number of frames per second of the image signal is 70.

In this case, the controller 170 may control local dimming depending on the adjusted screen refresh rate. In other words, the controller 170 may calculate local dimming data to be matched to the vertical synchronizing signal, and may control local dimming depending on the calculated data.

Referring to FIG. 10, a dotted line shown on the local dimming data may represent data calculated and applied in a specific period regardless of a conventional vertical synchronizing signal, and a solid line may represent data calculated and applied in response to the vertical synchronizing signal according to the present disclosure.

In this case, the local dimming is performed to be matched to an image frame currently displayed on the display 180.

However, as described above, when the screen refresh rate is adjusted to a specific frequency or less, the flicker is not caused.

Accordingly, the controller 170 may increase the adjusted screen refresh rate.

The following description will be made with reference to FIG. 9 again.

The controller 170 may multiply the adjusted screen refresh rate (S15).

In detail, the controller 170 may increase the adjusted screen refresh rate in various manners depending on the image signal, and one of the manners is to multiply the adjusted screen refresh rate.

In other words, the controller 170 may increase the adjusted screen refresh rate to a frequency corresponding to an integer multiple thereof, depending on the image signal.

For example, the controller 170 may increase the screen refresh rate to be twice, but is provided for the illustrative purpose. In other words, the controller 170 may increase the screen refresh rate to be four times or more.

Meanwhile, according to a first embodiment, the controller 170 may unconditionally increase a screen refresh rate adjusted depending on the image signal while performing the VRR function.

For example, when the screen refresh rate is sequentially adjusted to 120 Hz, 120 Hz, 58 Hz, or 70 Hz while performing the VRR function, the controller 170 may multiply the adjusted screen refresh rate of 120 Hz, 120 Hz, 58 Hz, or 70 Hz to 240 Hz, 240 Hz, 116 Hz, or 140 Hz, respectively.

According to the second embodiment, the controller 170 may increase the screen refresh rate, only when the screen refresh rate, which is adjusted depending on the image signal while the VRR function is being performed, is equal to or less than a preset frequency. In this case, the controller 170 may maintain the screen refresh rate adjusted depending on the image signal, when the screen refresh rate adjusted depending on the image signal exceeds the preset frequency.

For example, the controller 170 may set, to 55 Hz, a frequency serving as a reference for increasing a screen refresh rate. In other words, in this case, the controller 170 may increase the screen refresh rate, when the screen refresh rate adjusted depending on the image signal is 55 Hz.

For example, when sequentially adjusting the screen refresh rate to 120 Hz, 120 Hz, 58 Hz, or 70 Hz while the VRR function is being performed, the controller 170 may maintain or multiply the adjusted screen refresh rate of 120 Hz, 120 Hz, 58 Hz, or 70 Hz to 120 Hz, 120 Hz, 116 Hz, or 40 Hz.

Meanwhile, the frequency serving as the reference for increasing the screen refresh rate is set to 55 Hz by way of example, but the present disclosure is not limited thereto.

The controller 170 may set an arbitrary frequency expected to cause the flicker, to the frequency serving as the reference for increasing the screen refresh rate.

The controller 170 may receive an installation environment or a use environment of the display device 100 to set the frequency serving as the reference for increasing the screen refresh rate.

For example, when a current time is a night time band (for example, the time period ranging from 17:00 p.m. to 5:00 a.m.), the controller 170 may set the frequency serving as the reference for increasing the screen refresh rate to a first frequency (for example, 40 Hz). When the current time is a day time band (for example, the time period ranging from 5:00 a.m. to 17:00 a.m.), the controller 170 may set the frequency serving as the reference for increasing the screen refresh rate to a second frequency (for example, 55 Hz) higher than the first frequency.

However, a method for changing the frequency serving as the reference for increasing the screen refresh rate, depending on the time band as described above is provided for the illustrative purpose.

For another example, when the set brightness of the display device 100 is less than a reference value (for example, 50 in the range of 1 to 100), the controller 170 may set the frequency serving as the reference for increasing the screen refresh rate to the first frequency (for example, 40 Hz). When the set brightness of the display device 100 is equal to or greater than a reference value (for example, 50 in the range of 1 to 100), the controller 170 may set the frequency serving as the reference for increasing the screen refresh rate to the second frequency (for example, 55 Hz) higher than the first frequency.

As described above, according to various embodiments, the controller 170 may increase the screen refresh rate to the second frequency higher than the first frequency, when the screen refresh rate is acquired to the first frequency based on the image signal.

Figure 11:
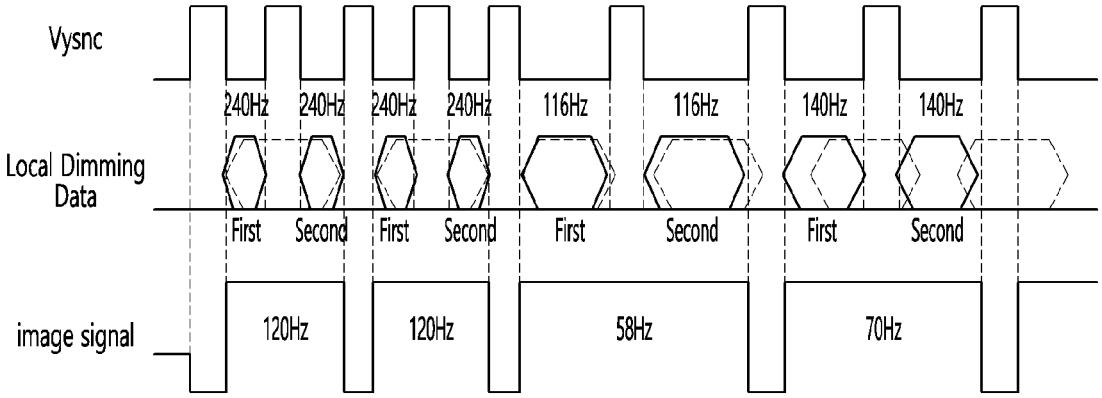
FIG. 11 is a view illustrating output timing of a vertical synchronizing signal Vsync and local dimming data, after multiplying the vertical synchronizing signal Vsync depending on an image signal, while a display device performs a VRR function according to an embodiment of the present disclosure.

FIG. 11 is a view illustrating output timing of a vertical synchronizing signal Vsync and local dimming data, after multiplying the vertical synchronizing signal Vsync depending on an image signal, while a display device performs a VRR function according to an embodiment of the present disclosure.

As illustrated in FIG. 11, the controller 170 may increase the screen refresh rate to be twice.

For example, the controller 170 may increase the screen refresh rate from 120 Hz to 240 Hz, when the number of frames per second of the image signal 120, may increase the screen refresh rate from 58 Hz to 116 Hz, when the number of frames per second of the image signal 58, and may increase the screen refresh rate from 70 Hz to 140 Hz, when the number of frames per second of the image signal 70. In this case, the controller 170 may increase a transmission frequency of a vertical synchronizing signal to be twice. Accordingly, even the frequency for controlling local dimming may be adjusted to be identical to the vertical synchronizing signal.

The following description will be made with reference to FIG. 9 again.

The controller 170 may control the backlight unit 250 and the local dimming depending on the multiplied screen refresh rate (S17).

The backlight unit 250 and the backlight dimming controller 510 may be drive depending on the screen refresh rate increased by the frame rate converter 350.

The controller 170 may increase the operating frequency of the backlight unit depending on the multiplied screen refresh rate. In other words, the controller 170 may increase the transmission frequency of the vertical synchronizing signal identically to the screen refresh rate, by increasing the screen refresh rate. In this case, as the transmission frequency of the vertical synchronizing signal is increased, the operating frequency of the backlight unit 250 provided in the display 180 may be increased together.

For example, on the assumption that the number of frames per second of the image signal is in the range of about 48 frames to 120 frames, the controller 170 may increase the screen refresh rate from 98 Hz to 240 Hz by multiplying the screen refresh rate to be twice. Accordingly, since the screen refresh rate is at least 98 Hz, even the frequency of the vertical synchronizing signal is at least 98 Hz. Accordingly, since even the operating frequency of the backlight unit 250 is at least 98 Hz, the user may minimize the case of experiencing the flicker phenomenon.

In addition, the controller 170 may increase a frequency for calculating local dimming data by increasing the screen refresh rate.

In detail, the controller 170 may multiply the vertical synchronizing signal, as the screen refresh rate is multiplied, and may calculate and control local dimming data in response to the multiplied vertical synchronizing signal. In this case, a plurality of local dimming data for an image displayed for one second may be calculated. For example, when the vertical synchronizing signal is multiplied to be twice, two pieces of local dimming data may be calculated with respect to an image displayed for one second.

Referring to FIG. 11, a dotted line illustrated on the local dimming data may represent data calculated and applied in a specific period regardless of the conventional vertical synchronizing signal, and a solid line may represent data calculated and applied in response to the vertical synchronizing signal according to the present disclosure.

As described above, when calculating and applying the local dimming data in response to the multiplied vertical synchronizing signal, the controller 170 may control local dimming based on the local dimming data which is first calculated, and may not process local dimming data which is second calculated. In other words, the controller 170 may apply only the local dimming data, which is first calculated, to the display 180, and may not apply the local dimming data, which is second calculated, to the display 180.

As the controller 170 multiplies the vertical synchronizing signal, the controller 170 may calculate a plurality of local dimming data. In this case, since the same image signal is used, a plurality of identical local dimming data may be calculated. Accordingly, when the controller 170 multiples the vertical synchronizing signal, the controller 170 may control the backlight dimming controller 510 to perform local dimming based on the local dimming data which is first calculated, and may not process the local dimming data which is second calculated.

As described above, the controller 170 may calculate the local dimming data and control local dimming, in response to the vertical synchronizing signal such that the local dimming to be matched to the image signal is performed regardless of the change in frame of the image signal. In addition, a load for processing data may be reduced by processing only the local dimming data which is first calculated.

Figure 12:
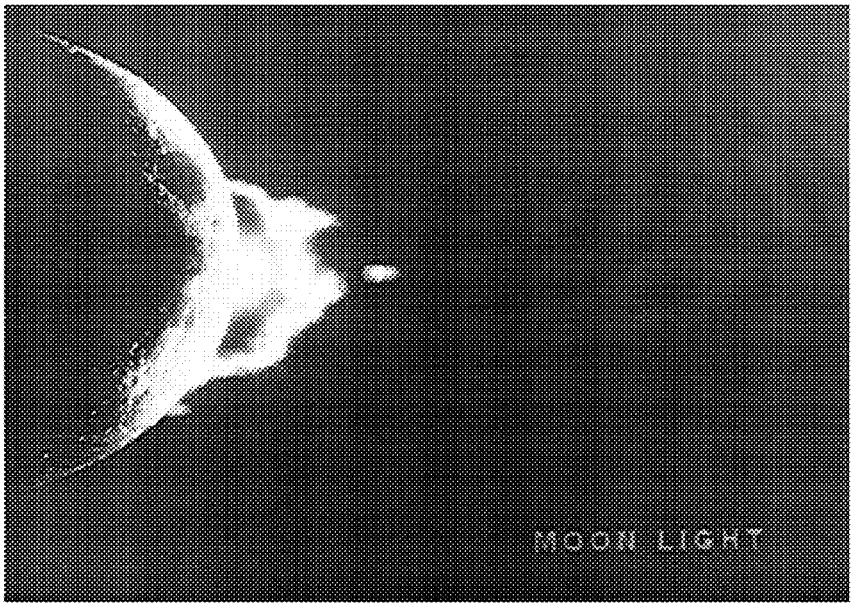
FIG. 12 is a view illustrating an image when a screen refresh rate, which is adjusted, is not increased or an image when a screen refresh rate is increased, after the screen refresh rate is adjusted when a display device is performing a VRR function according to an embodiment of the present disclosure.
Figure 12:
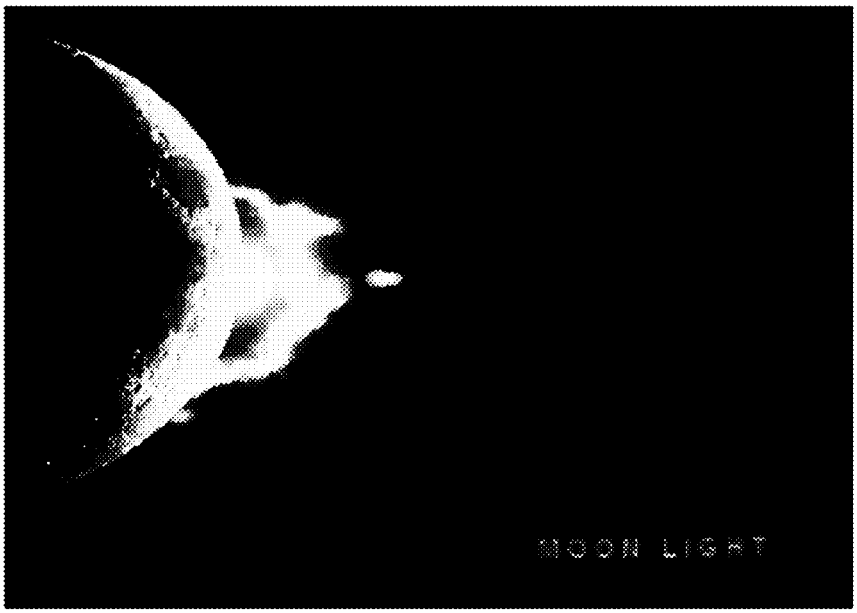

FIG. 12 is a view illustrating an image when a screen refresh rate, which is adjusted, is not increased or an image when a screen refresh rate is increased, after the screen refresh rate is adjusted when a display device is performing a VRR function according to an embodiment of the present disclosure.

FIG. 12A illustrates an image obtained by capturing one scene of an image output, when a conventional display device performs a VRR function, and FIG. 12B illustrates an image obtained by capturing the same scene while outputting the same image as that of FIG. 12A, when a display device according to an embodiment of the present disclosure performs a VRR function.

As illustrated in FIG. 12, the conventional display device outputs an image having a lower contrast, as the conventional display device does not apply the local dimming to be matched to the image, which is currently output, while the display device according to an embodiment of the present disclosure outputs an image having a higher contrast, as the display device according to an embodiment of the present disclosure applies the local dimming to be matched to the image which is currently output.

In addition, in the display device according to an embodiment of the present disclosure, the backlight unit 250 is driven to be matched to be a time point at which the image frame is changed. Accordingly, the image is smoothly changed and the image quality is improved.

The above description is merely illustrative of the technical idea of the present disclosure, and various modifications and changes may be made thereto by those skilled in the art without departing from the essential characteristics of the present disclosure.

Therefore, the embodiments of the present disclosure are not intended to limit the technical spirit of the present disclosure but to illustrate the technical idea of the present disclosure, and the technical spirit of the present disclosure is not limited by these embodiments.

The scope of protection of the present disclosure should be interpreted by the appending claims, and all technical ideas within the scope of equivalents should be construed as falling within the scope of the present disclosure.

The invention claimed is:

1. A display device comprising:

a display, a controller operatively connected to the display, wherein the controller is configured to:

receive a sequence of images, extract, from each image of the sequence of images, an image specific frequency of a vertical synchronizing signal of a corresponding image, determine whether or not one of the extracted image specific frequencies is below a threshold frequency while another one of the extracted image specific frequencies is not below the threshold frequency, and upon determining that one of the extracted image specific frequencies is below the threshold frequency while the another one of the extracted image specific frequencies is not below the threshold frequency:

increase an image specific screen refresh rate of all images of the sequence of images by a common factor, and control the display to display the sequence of images with the image specific screen refresh rate that has been increased by the common factor.

2. The display device of claim 1, wherein the threshold frequency is 55 Hz.

3. The display device of claim 1, wherein the controller is configured to:

upon determining that none of the extracted image specific frequencies is below the threshold frequency:

maintain the image specific screen refresh rate of all images of the sequence of images, and control the display to display the sequence of images with the image specific screen refresh rate that has been maintained.

4. The display device of claim 1, wherein the image specific frequency of the vertical synchronizing signal is extracted based on an image specific number of frames per second.

5. The display device of claim 4, wherein the controller includes:

an image decoder to acquire the image specific number of frames per second by decoding the image signal, and to acquire the image specific screen refresh rate based on the image specific number of frames per second; and a frame rate converter to increase the image specific screen refresh rate acquired by the common factor, and wherein the display includes a backlight unit and a backlight dimming controller that are driven based on the image specific screen refresh rate of all images of the sequence of images that has been increased by the common factor.

6. The display device of claim 1, wherein the controller is configured to:

increase an operating frequency of a backlight unit provided in the display based on the increase of the image specific screen refresh rate.

7. The display device of claim 1, wherein the controller is configured to:

increase a frequency for calculating local dimming data based on the increase of the image specific screen refresh rate.

8. The display device of claim 7, wherein the controller is configured to:

apply local dimming to the sequence of images based on the increase of the image specific screen refresh rate.

9. The display device of claim 1, further comprising:

an external device interface connected to an external device which provides the sequence of images.

10. An operating method of a display device, the operating method comprising:

receiving a sequence of images;

extracting, from each image of the sequence of images, an image specific frequency of a vertical synchronizing signal of a corresponding image;

determining whether or not one of the extracted image specific frequencies is below a threshold frequency while another one of the extracted image specific frequencies is not below the threshold frequency; and upon determining that one of the extracted image specific frequencies is below the threshold frequency while the another one of the extracted image specific frequencies is not below the threshold frequency:

increasing an image specific screen refresh rate of all images of the sequence of images by a common factor; and displaying the sequence of images with the image specific screen refresh rate that has been increased by the common factor.

* * * * *